United States Patent [19]

Poulenard et al.

[11] Patent Number: 4,921,634

[45] Date of Patent: May 1, 1990

[54] EMULSIONS OF FLUORINATED PRODUCTS

[75] Inventors: Jacques Poulenard; Louis Gavet, both of Lyons; Roger Chatelin, Lissieu per Lozanne; Annie Giorgio, Villeurbanne, all of France

[73] Assignee: Institut Textile de France, Cedex, France

[21] Appl. No.: 181,727

[22] Filed: Apr. 14, 1988

[30] Foreign Application Priority Data

Apr. 14, 1987 [FR] France ..... 87 05307

[51] Int. Cl.[5] ..... C09K 13/02

[52] U.S. Cl. ..... 252/312; 252/355; 514/832; 514/833

[58] Field of Search ..... 252/312, 355; 514/832, 514/833

[56] References Cited

U.S. PATENT DOCUMENTS 3,042,642 7/1962 De Marco ..... 260/29.6
4,029,658 6/1977 Samour ..... 260/247.1
4,431,595 2/1984 Hashimoto et al. ..... 252/355
4,729,849 3/1988 Hisamoto et al. ..... 252/355

FOREIGN PATENT DOCUMENTS 1300250 12/1972 United Kingdom .

*Primary Examiner*—Mary C. Lee
*Assistant Examiner*—C. S. K. Scalzo
*Attorney, Agent, or Firm*—Shenier & O'Connor

[57] ABSTRACT

The invention consists in making an emulsion of a fluorinated product, in the presence of a derivative of morpholine. The derivative of morpholine may be the morpholine itself, a saturated derivative or a non-saturated derivative, for example morpholinoethyl methacrylate. The fluorinated product may be a fluorinated monomer, for example 3,3,4,4,5,5,6,6,7,7,8,8,8-tridecafluorooctyl methacrylate. Placing in emulsion is effected by adding to the fluorinated product the derivative of morpholine in the presence of a surface-active agent, and by adjusting, with mechanical stirring, the desired quantity of liquid.

9 Claims, No Drawings

EMULSIONS OF FLUORINATED PRODUCTS

The present invention relates to emulsions of fluorinated products. The term fluorinated products is taken here in a broad sense: it includes perfluorinated products and covers all saturated and non-saturated fluorinated and perfluorinated products. On the other hand, the term product is taken in a restrictive sense: it designates solely those products which are capable of being placed in emulsion, namely, for the fluorinated products, monomers, homopolymers or copolymers with fluorinated components.

Placing a liquid in emulsion in another liquid is a known technique which generally employs, in addition to a mechanical stirring, a certain quantity of surface-active agents. An emulsion is required to be stable in time, i.e. the distribution of the particles (in size and in volume) of the liquid in emulsion in the other liquid remains homogeneous and constant for a fairly long period of time. Now, to Applicants' knowledge, not only do the emulsions of fluorinated products require a considerable mechanical stirring and a large quantity of surface-active agents, but they are not stable in time.

An emulsion of fluorinated products has now been found, and this forms the subject matter of the invention, which is simple to make and which presents the required stability. The emulsion according to the invention is characterized by the presence, in complement of the fluorinated product, of a derivative of morpholine.

The derivative of morpholine may be the morpholine itself ($C_4H_9NO$) or one of its saturated or non-saturated derivatives, advantageously non-ionic. Among saturated derivatives, the following will be chosen for example: N-methylmorpholine ($C_5H_{11}NO$), morpholinoethanol ($C_6H_{13}NO_2$) or morpholinoisopropanol ($C_7H_{15}NO_2$). Among the non-saturated derivatives, morpholinoethyl acrylate ($C_9H_{15}NO_3$) and morpholinoethyl methacrylate ($C_{10}H_{17}NO_3$) will be particularly retained; the latter will be designated in the following specification as MEMA, of structural formula:

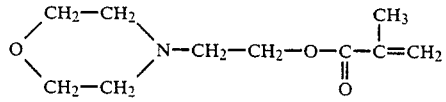

It is known that certain derivatives of morpholine have already been used as emulsifiers. This is the case of amine soap obtained by reaction of fatty acids on a derivative of morpholine, used in emulsions of waxes in accordance with Patents FR-A-1 270 244, FR-A-2 122 043 and FR-A-827 911. It is the case of cationic derivatives of morpholine employed in emulsions of organopolysiloxane according to FR-A-2 038 255 or in polymeric latex emulsions according to US-A-4 029 658. To Applicants' knowledge, the derivatives of morpholine have not been used for placing fluorinated products in emulsion, and more particularly the non-ionic derivatives of morpholine.

Among the products most difficult to place in emulsion by the known techniques and whose production is facilitated by the process of the invention, the perfluorinated products will be retained and in particular 3,3,4,4,5,5,6,6,7,7,8,8,8-tridecafluorooctyl methacrylate which will be designated in the following specification as FOMA, of structural formule:

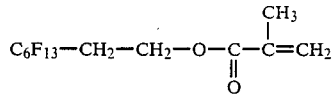

It is a further object of the invention to provide a process for preparing the emulsion set forth hereinabove. According to the process of the invention, there is added to the fluorinated product a derivative of morpholine in the presence of at least one surface-active agent then the desired quantity of liquid is added to the solution obtained, with mechanical stirring. The presence of the derivative of morpholine quite unexpectedly facilitates placing in emulsion and gives the emulsion a very good stability. It seems that the derivative of morpholine performs the role of co-solvent with respect to the fluorinated product. In the presence of a small quantity of liquid, of the order of some percent, the mixture obtained is like a solution; in the presence of a larger quantity of liquid, the whole emulsifies.

The derivative of morpholine and the fluorinated product are such as described hereinabove. The surface-active agents used are of known type, ionic or non-ionic. They may be fluorinated.

The relative proportions between the different constituents of the emulsion are very variable, as a function of the desired concentration of products to be emulsified.

The molar ratio between the derivative of morpholine and the fluorinated product is preferably of the order of 2. Taking into account the double molar mass of the FOMA with respect to the MEMA, the preferred ratio by weight between the MEMA and the FOMA is of the order of the unit.

The quantity by weight of the surface-active agent is preferably of the order of or less than 10% of the accumulated weight of the derivative of morpholine and of the product to be emulsified.

With the MEMA and the FOMA, results have been obtained according to the invention in the following range of concentration by weight:

morpholinoethyl methacrylate (MEMA): from 0.25 to 25%;

3,3,4,4,5,5,6,6,7,7,8,8,8-tridecafluorooctyl methacrylate (FOMA): from 0.25 to 25%;

surface-active agent: from 0.1 to 50%;

water: qsp 100%.

The invention will be more readily understood on reading the following description of embodiments.

EXAMPLE 1

Two hundred grams of FOMA are taken, to which are added ten grams of a non-ionic surface-active agent. About 1.8 liter of water is added with mechanical stirring. When the mechanical stirring is stopped, it is observed that the emulsion decants immediately. In the absence of derivatives of morpholine, the emulsion breaks as soon as there is no stirring.

EXAMPLE 2

One hundred grams of FOMA are taken, to which are added one hundred grams of MEMA and ten grams of a non-ionic surface-active agent. The mixture obtained is like a solution. A certain quantity of water is added with mechanical stirring. After having added 1.8 liter of water, the total concentration of monomers (MEMA and FOMA) being of the order of 10%, a translucent emulsion is obtained. If water continues to be added, for example 18 additional liters to arrive at a monomer of concentration of 1%, an emulsion is obtained which looks like a transparent solution. The emulsions obtained are stable in time.

EXAMPLE 3

In order to check good stability of the emulsion as to the size of the particles, an emulsion is made according to the invention from ten grams of FOMA to which are added ten grams of MEMA and one gram of non-ionic surface-active agent, then 1.8 liter of water is added with mechanical stirring. A translucent emulsion is obtained which looks like a solution. The total concentration of monomer (MEMA, FOMA) is of the order of 1%. The size of the particles is measured by diffusion of light with the aid of an apparatus marketed under the trademark "COULTER NANO SIZER®" by the firm COULTER ELECTRONICS LTD. The results obtained are shown in the following Table:

| time (hour) | size (in nanometers) |
|---|---|
| 1 | 230 |
| 3 | 270 |
| 6.5 | 306 |
| 24 | 360 |

The size of the particles develops, but the emulsion does not break.

EXAMPLE 4

In order to check the good stability of the emulsion in time, an emulsion is made according to the invention from fifty grams of FOMA to which are added fifty grams of MEMA, and five grams of non-ionic surface-active agent with 1.8 liter of water, with stirring. A translucent emulsion is obtained, having the appearance of a solution, of which the total concentration of monomers is of the order of 5%.

One hundred grams of this emulsion are placed in a decantation column and its evolution is monitored visually. After 48 hours, no deposit is observed in the bottom of the column. After one week, a deposit is formed but the emulsion is resumed simply by mechanical stirring.

What is claimed is:

1. An emulsion comprising a fluorinated ingredient, at least one surface-active agent and morpholine.

2. An emulsion comprising a fluorinated ingredient, at least one surface-active agent and a derivative of morpholine.

3. The emulsion of claim 2, wherein the quantity by weight of the surface-active agent is equal to or less than 10% of the total weight of the derivative of morpholine and of the fluorinated ingredients.

4. The emulsion of claim 2, wherein the derivative of morpholine is a saturated non-ionic derivative such as N-methylmorpholine, morpholino-ethanol or morpholino-isopropanol.

5. The emulsion of claim 2, wherein the derivative of morpholine is a non-saturated non-ionic derivative, such as morpholinoethyl acrylate or methacrylate.

6. The emulsion of any one of claims 1, 2, 4 or 5, wherein the fluorinated ingredient is a perfluorinated ingredient.

7. The emulsion of any one of claims 1, 2, 4 or 5, wherein the fluorinated ingredient is 3,3,4,4,5,5,6,6,7,7,8,8,8-tridecafluorooctyl methacrylate of formula:

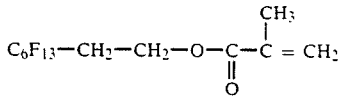

8. The emulsion of claim 2 wherein the molar ratio of the derivative of morpholine and the fluorinated ingredient is substantially equal to two.

9. The emulsion of claim 1 wherein the quantity by weight of the surface-active agent is equal to or less than 10% of the total weight of morpholine and of the fluorinated ingredients.

* * * * *